US009151570B2

(12) United States Patent
Plaster

(10) Patent No.: US 9,151,570 B2
(45) Date of Patent: Oct. 6, 2015

(54) SYNCHRONIZED ELEVATION TRAJECTORY RIFLESCOPE

(71) Applicant: Bushnell, Inc., Overland Park, KS (US)

(72) Inventor: John Plaster, Iron River, WI (US)

(73) Assignee: BUSHNELL, INC., Overland Park, KS (US)

( * ) Notice: Subject to any disclaimer, the term of this patent is extended or adjusted under 35 U.S.C. 154(b) by 349 days.

(21) Appl. No.: 13/661,785

(22) Filed: Oct. 26, 2012

(65) Prior Publication Data

US 2014/0115942 A1 May 1, 2014

(51) Int. Cl.
*F41G 1/38* (2006.01)

(52) U.S. Cl.
CPC ..... *F41G 1/38* (2013.01)

(58) Field of Classification Search
CPC ..... F41G 1/38
USPC ..... 42/126, 111, 119, 122
See application file for complete search history.

(56) References Cited

U.S. PATENT DOCUMENTS

| | | | | |
|---|---|---|---|---|
| 4,248,496 | A | 2/1981 | Akin, Jr. et al. | |
| 4,777,352 | A | 10/1988 | Moore | |
| 4,965,439 | A | 10/1990 | Moore | |
| 5,026,158 | A | 6/1991 | Golubic | |
| 5,375,072 | A | 12/1994 | Cohen | |
| 6,269,581 | B1 | 8/2001 | Groh | |
| 6,516,699 | B2 | 2/2003 | Sammut et al. | |
| 6,772,550 | B1 | 8/2004 | Leatherwood | |
| 6,862,832 | B2 | 3/2005 | Barrett | |
| 7,350,329 | B1 | 4/2008 | Bell et al. | |
| 7,516,571 | B2 | 4/2009 | Scrogin et al. | |
| 7,624,528 | B1 | 12/2009 | Bell et al. | |
| 7,654,029 | B2 | 2/2010 | Peters et al. | |
| 7,703,679 | B1 | 4/2010 | Bennetts et al. | |
| 7,703,719 | B1 | 4/2010 | Bell et al. | |
| 7,806,331 | B2 | 10/2010 | Windauer et al. | |
| 8,713,843 | B2 * | 5/2014 | Windauer | 42/113 |
| 2004/0231220 | A1 | 11/2004 | McCormick | |

* cited by examiner

*Primary Examiner* — Reginald Tillman, Jr.
(74) *Attorney, Agent, or Firm* — Hovey Williams LLP

(57) ABSTRACT

A riflescope comprises a body, an elevation knob, a windage knob, and an eyepiece. The elevation knob may be mounted on the body and configured to generate an elevation setting corresponding to the elevation of the riflescope. The windage knob may be mounted on the body and configured to generate a windage setting corresponding to the left and right offset of the riflescope. The eyepiece is for viewing a target and may include a display configured to show a range to the target as determined by the elevation knob or the offset determined by the windage knob.

18 Claims, 4 Drawing Sheets

SYNCHRONIZED ELEVATION TRAJECTORY RIFLESCOPE

BACKGROUND OF THE INVENTION

Rifles and other firearms often employ telescopic sights or riflescopes to assist a shooter in aiming and hitting targets. Because a bullet's trajectory is an arc rather than a flat line, many riflescopes incorporate a means to mechanically change or adjust the elevation, so that the resulting reticle or aiming point setting coincides with a given point in a bullet's trajectory, for a given distance or range. Thus, the shooter's point of aim coincides with the bullet's point of impact. To achieve this coincidence, the shooter must know the bullet's trajectory at each distance he intends to fire, or carry such trajectory data in the field, interpret how he must calibrate this data to the increments of his elevation, manually apply this data by setting or resetting the riflescope's elevation, and only then reacquire his target in the scope's field of view and take a well-aimed shot. To do this, the shooter must have an extensive knowledge of ballistics and must understand the degree to which his incremental elevation adjustments affect his point of impact at any distance. Unfortunately, these steps often cause shooters to lose sight of the target while resetting the scope's elevation for the required distance. Further, because the elevation knob or turret presents its numerical settings in small print, a shooter can have difficulty seeing any particular setting under ideal lighting, and cannot see the settings at all in darkness. Likewise, a riflescope's horizontal or windage adjustments to compensate for the effects of wind or target movement are confusing and too easily incorrect.

SUMMARY OF THE INVENTION

Embodiments of the current invention solve the above-mentioned problems and provide a distinct advance in the art of riflescopes. More particularly, embodiments of the invention provide a riflescope that displays an elevation or windage setting in an eyepiece.

Various embodiments of the current invention provide a riflescope broadly comprising a body, an elevation knob, a windage knob, and an eyepiece. The elevation knob may be mounted on the body and configured to generate an elevation setting corresponding to the elevation of the riflescope. The windage knob may be mounted on the body and configured to generate a windage setting corresponding to the left and right offset of the riflescope. The eyepiece is for viewing a target and may include a display configured to show a range to the target as determined by the elevation knob and the offset determined by the windage knob.

Other embodiments of the current invention provide a riflescope comprising a body, an elevation knob, an elevation sensor, a windage knob, a windage sensor, and an eyepiece. The elevation knob may be mounted on the body and configured to generate an elevation setting corresponding to the elevation of the riflescope. The elevation sensor may be positioned on the body beneath the elevation knob and configured to detect the elevation setting. The windage knob may be mounted on the body and configured to generate a windage setting corresponding to the left and right offset of the riflescope. The windage sensor may be positioned on the body beneath the windage knob and configured to detect the windage setting. The eyepiece is for viewing a target and may include a display configured to show a range to the target as determined by the elevation knob and the offset determined by the windage knob.

Other embodiments of the current invention provide a riflescope comprising a body, an elevation knob, an elevation sensor system, a windage knob, a windage sensor system, and an eyepiece. The elevation knob may be mounted on the body and configured to generate an elevation setting corresponding to the elevation of the riflescope. The elevation sensor system may include a plurality of elevation position indicators located around the circumference of the elevation knob and an elevation sensor positioned on the body beneath the elevation knob configured to detect the elevation setting. The windage knob may be mounted on the body and configured to generate a windage setting corresponding to the left and right offset of the riflescope. The windage sensor system may include a plurality of windage position indicators located around the circumference of the windage knob and a windage sensor positioned on the body beneath the windage knob configured to detect the windage setting. The eyepiece is for viewing a target and may include a display configured to show a range to the target as determined by the elevation knob and the offset determined by the windage knob.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 1:
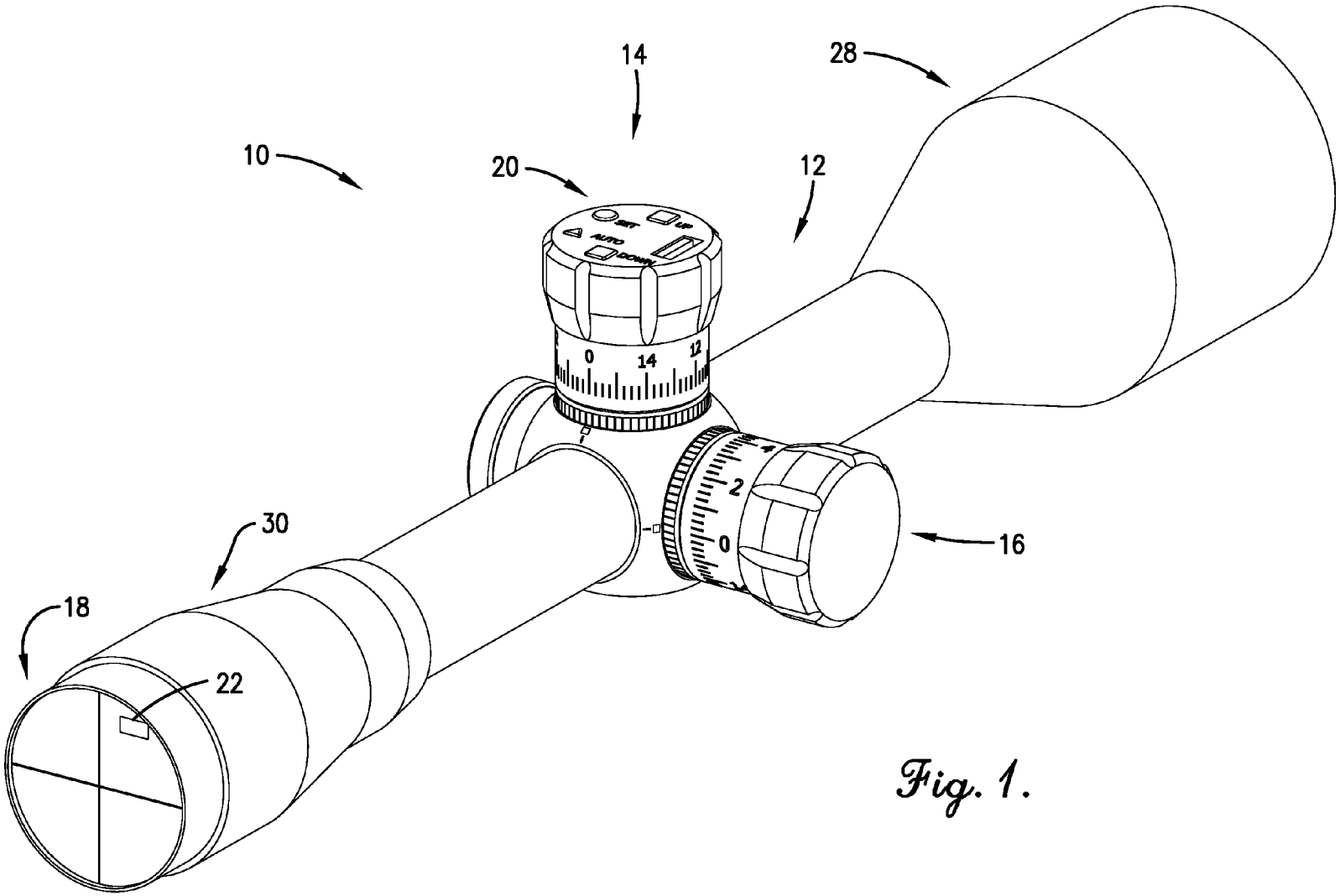
FIG. 1 is a perspective view of a riflescope including an eyepiece, an elevation knob, and a windage knob constructed in accordance with various embodiments of the current invention.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "various embodiments" mean that the feature or features being referred to are included in at least one embodiment of the technology. Separate references to "one embodiment", "an embodiment", or "various embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Figure 5:
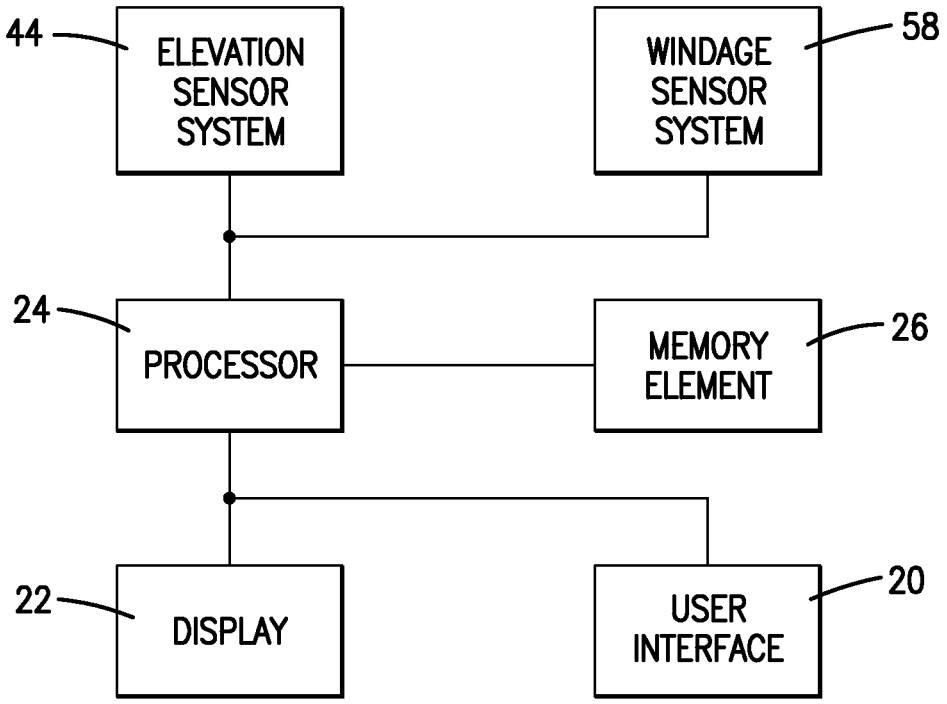
FIG. 5 is a block diagram of electronic components of the riflescope.

A riflescope 10, constructed in accordance with various embodiments of the current invention, is shown in FIG. 1 and may broadly comprise a body 12, an elevation knob 14, a windage knob 16, and an eyepiece 18. The riflescope 10 may further comprise a user interface 20, a display 22, a processor 24, and a memory element 26, as shown in FIG. 5.

The body 12 is elongated with a generally cylindrical or tubular shape and may be manufactured from metal, such as aluminum or alloys thereof. The elevation knob 14 may be coupled to the top of the body 12, and the windage knob 16 may be coupled to the right side of the body 12. The body 12 may couple with or include an objective 28 at a distal end with a lens assembly into which light enters to form an image displayed on the eyepiece 18. The eyepiece 18 may be located at a proximal end of the body 12. A magnification and/or focusing knob 30 may accompany the eyepiece 18.

Figure 4:
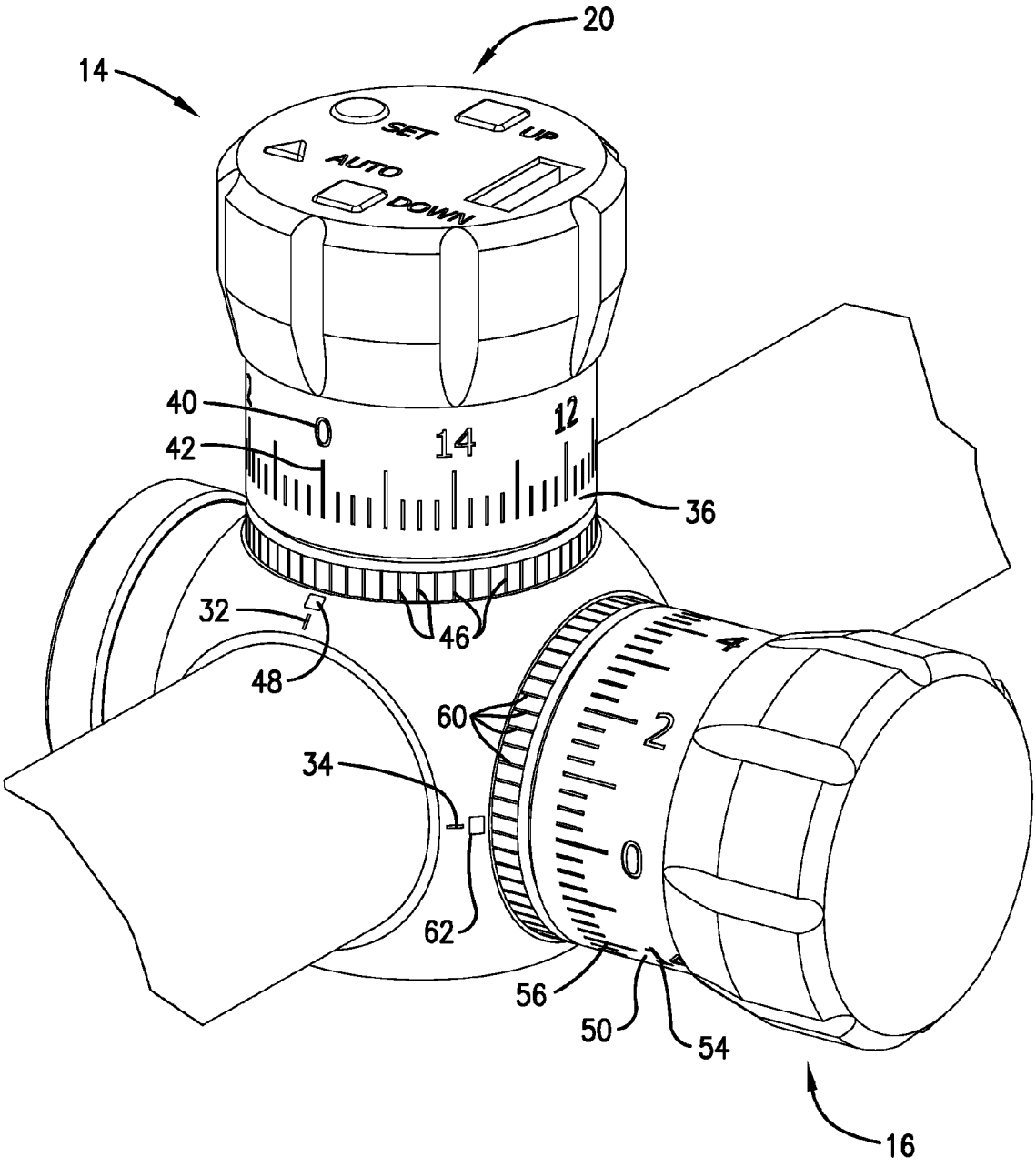
FIG. 4 is a perspective view of a portion of the riflescope with perspective views of the elevation knob and the windage knob.

An elevation witness mark 32 and a windage witness mark 34 may be formed on the body 12. The witness marks 32, 34 may be elongated narrow lines either affixed to or etched in the surface of the body 12 or the base of the knobs 14, 16 that are aligned with the longitudinal axis of the riflescope 10. The elevation witness mark 32 may be positioned adjacent to the elevation knob 14, as seen in FIGS. 1 and 4, and the windage witness mark 34 may be positioned adjacent to the windage knob 16. The witness marks 32, 34 may determine the setting of the knobs 14, 16, as discussed below.

Other components not shown in the figures may be attached to the body 12 such as a parallax compensation adjuster, an illumination adjuster, and a mounting rail located along the bottom of the body 12 used for attaching the riflescope 10 to a firearm such as a rifle.

The elevation knob 14, as shown in FIGS. 1-4, is generally cylindrical shaped with a circumferential knob wall 36 and may include indentations or other features on an outer surface thereof that assist the user in rotating the elevation knob 14. The elevation knob 14 may also include a plurality of elevation numerals 40 uniformly distributed along the outer surface with a plurality of elevation indicia 42, or tick marks, positioned therebetween. The elevation numerals 40 may be upright and aligned with the rotational axis of the elevation knob 14. The elevation numerals 40 and elevation indicia 42 may be affixed, such as with paint or transfers, or etched into the surface of the elevation knob 14. The elevation numerals 40 may represent whole units of elevation settings, such as minutes of angle (MOA), centimeters, or milliradians. The elevation indicia 42 may include short, vertical lines or hash marks and may represent fractional units of settings. The setting of the elevation knob 14 may be determined by the elevation numeral 40 or elevation indicia 42 that is aligned with the elevation witness mark 32. An exemplary elevation knob 14 may include sixty elevation indicia 42, each representing 0.25 MOA.

The elevation knob 14 may include an elevation sensor system 44 which determines the angular position of the elevation knob 14, and in turn the elevation setting. The elevation sensor system 44 may include a plurality of elevation position indicators 46 and an elevation sensor 48, as shown in FIG. 4. The elevation position indicators 46 may be positioned at the base of the elevation knob 14 close to the outer circumference of the knob wall 36. In addition, the elevation position indicators 46 may be positioned such that each indicator 46 is aligned with one elevation indicia 42. An exemplary elevation sensor system 44 may include sixty elevation position indicators 46. In some embodiments, the elevation position indicators 46 may include micro-magnetic fibers which may be elongated and rigid and formed from electrically conductive material, such as wires. The micro-magnetic fibers may be oriented parallel with the longitudinal axis of the elevation knob 14. In other embodiments, the elevation position indicators 46 may include electro-magnet dots, which may also be formed from electrically conductive material. The elevation position indicator 46 that is aligned with the elevation indicia 42 of "0" may have a unique feature that distinguishes it from the other elevation position indicators 46.

The elevation sensor 48 may include sensors capable of detecting the presence of the elevation position indicators 46 such that the positioning of an elevation position indicator 46 over the elevation sensor 48 completes a circuit or closes a gate. In other embodiments, the elevation sensor 48 may include electromagnetic sensors that detect changes in a magnetic field, optical sensors that detect a reflection of the elevation position indicators 46, or the like. The elevation sensor 48 may be positioned below the elevation knob 14 on the body 12 of the riflescope 10. In various embodiments, the elevation sensor 48 may be positioned in line with the elevation witness mark 32. The elevation sensor 48 generally detects the angular position of the elevation knob 14 by sensing the presence and/or motion of the elevation position indicators 46 as the elevation position indicators 46 pass by the elevation sensor 48 while the elevation knob 14 is rotated. The elevation sensor 48 may provide a signal or data that represents the angular position of the elevation knob 14 to the processor 24. Since the angular position of the elevation knob 14 is also an indication of the alignment of the elevation indicia 42 with the elevation witness mark 32, the elevation sensor 48 may also provide a signal or data that represents the alignment of a particular elevation indicia 42 with the elevation witness mark 32 to the processor 24.

In alternative embodiments, the elevation sensor system 44 may include a multi-turn rotational encoder or a multi-turn potentiometer that generates an angular position of the elevation knob 14. The encoder or potentiometer may be fixedly coupled to the elevation knob 14 such that rotation of the elevation knob 14 also rotates the encoder or potentiometer. The encoder or potentiometer may generate a digital value or an electrical characteristic, such as voltage, current, resistance, etc., that can be converted into a digital value or electric signal corresponding to the angular position of the elevation knob 14 to be transmitted to the processor 24.

The windage knob 16, as shown in FIGS. 1-4, may be substantially similar to the elevation knob 14 in construction and may include a knob wall 50 with an outer surface, a plurality of windage numerals 54, and a plurality of windage indicia 56, or tick marks. In contrast to the elevation knob 14, the windage numerals 54 are rotated 90 degrees such that they appear transverse to the axis of rotation. The setting of the windage knob 16 may be determined by the windage numeral 54 or windage indicia 56 that is aligned with the windage witness mark 34.

The windage knob 16 may also include a windage sensor system 58 which determines the angular position of the windage knob 16, and thus the windage setting, that is substantially similar in structure and function to the elevation sensor system 44. Thus, the windage sensor system 58 includes a plurality of windage position indicators 60 and a windage sensor 62, as seen in FIG. 4, that are similar to the elevation position indicators 46 and the elevation sensor 48, respectively.

Both the elevation knob 14 and the windage knob 16 may have a normal operation mode and a reset mode. During normal operation, rotation of the elevation knob 14 changes the elevation setting and rotation of the windage knob 16 changes the windage setting. Both the elevation knob 14 and the windage knob 16 may include a mechanism by which the knobs 14, 16 can be rotated without changing the settings. Mechanisms may include a threaded top to each knob 14, 16, bolts or set screws that can be loosened, or the like. The mechanism may be manipulated in order to put the knobs 14, 16 in reset mode. For example, a threaded top of either knob 14, 16 may be loosened. The knob 14, 16 may then be rotated without changing its setting. The threaded top may be tightened after the knob 14, 16 has been rotated to return to normal operation.

Figure 2:
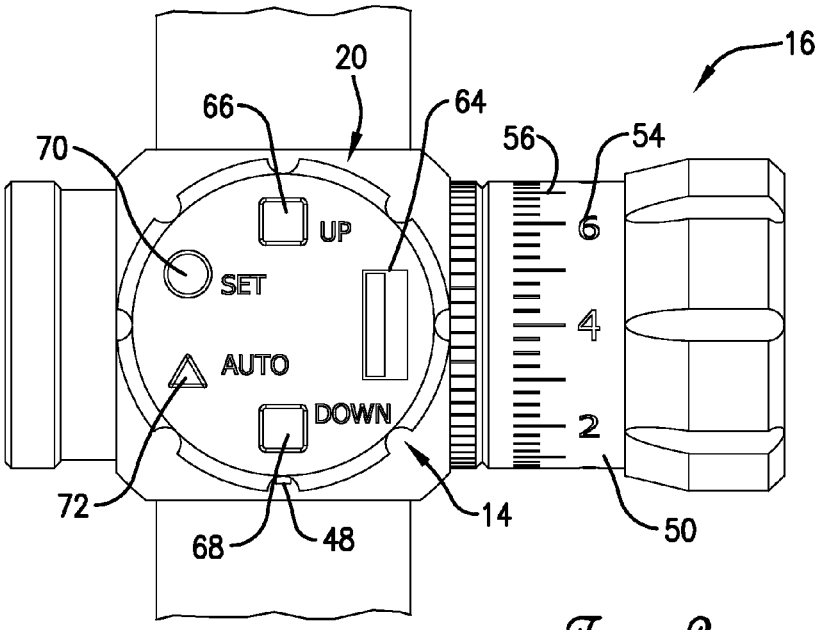
FIG. 2 is a top view of a portion of the riflescope with a top view of the elevation knob and a side view of the windage knob.

The user interface 20, as shown in FIG. 2, generally provides the user with the ability to enter data, change settings, or provide communication between the riflescope 10 and other devices or systems. The user interface 20 may include a plurality of controls and a communications port 64. The controls may be implemented as switches, buttons, pushbuttons, knobs, keypads, or the like, or combinations thereof, and may provide input to the processor 24. An exemplary user interface 20 may include an up control 66, a down control 68, a set control 70, and an auto control 72, although additional controls are possible and within the scope of the invention. The user interface 20 may be located on top of the elevation knob 14 or the windage knob 16. In some embodiments, the user interface 20 may be positioned elsewhere such as on the body 12. In other embodiments, the user interface 20 may be split such that a first portion of the user interface 20 is positioned on either or both of the knobs 14, 16 while a second portion is positioned on the body 12.

The up control 66 may provide incrementation of data that is shown on the display 22. An exemplary up control 66 is implemented as a pushbutton or pressure switch with a square shape labeled "UP", as seen in FIG. 2. In operation, the up control 66 may be actuated, such as by pressing the pushbutton, to increase the value of the number shown on the display 22. For example, the display 22 may show a range to the target in yards. By pressing the up control 66 button, the user may increase the value of the range in increments of 25 yards. The amount by which the value is incremented may depend on the context or the type of value that is being changed.

The down control 68 may provide decrementation of data that is shown on the display 22. An exemplary down control 68 is implemented as a pushbutton or pressure switch with a square shape labeled "DOWN", as seen in FIG. 2. In operation, the down control 68 may be actuated, such as by pressing the pushbutton, to decrease the value of the number shown on the display 22. For example, the display 22 may show a range to the target in yards. By pressing the down control 68 button, the user may decrease the value of the range in decrements of 25 yards. The amount by which the value is decremented may depend on the context or the type of value that is being changed.

The set control 70 may provide a data storage command. An exemplary set control 70 is implemented as a pushbutton or pressure switch with a circular shape labeled "SET", as seen in FIG. 2. In operation, the set control 70 may be actuated, such as by pressing the pushbutton, to store the setting of the elevation knob 14 or the windage knob 16 in the memory element 26. This action may be taken during the calibration process, as described below.

The auto control 72 may provide a data download command. An exemplary auto control 72 is implemented as a pushbutton or pressure switch with a triangular shape labeled "AUTO", as seen in FIG. 2. In operation, the auto control 72 may be actuated, such as by pressing the pushbutton, to automatically download ballistic data to the memory element 26. This action may be taken during the calibration or programming process, as described below.

The communications port 64 generally allows external devices and systems to communicate with the processor 24 and/or the memory element 26. The communications port 64 may include wired implementations that include a socket configured to receive a connector coupled to a cable or a component. The socket may have a parallel data configuration or a serial data configuration, such as a universal serial bus (USB) port, as shown in FIG. 2, which can receive a cable coupled to a device or a component like a flash memory drive. In addition to or instead of the wired socket configuration, the communications port 64 may include a wireless transmitter and receiver (transceiver) to send and receive data over the air. The wireless transceiver may operate in the radio frequency (RF) range and may utilize standards or protocols such as Bluetooth™ or the Institute of Electrical and Electronics Engineers (IEEE) 802.11 standards. Through the communications port 64 the riflescope may communicate with devices such as a rangefinder, a global positioning system (GPS) device, a cell phone, a tablet, a notebook computer, a laptop computer, or the like, or combinations thereof.

Figure 3:
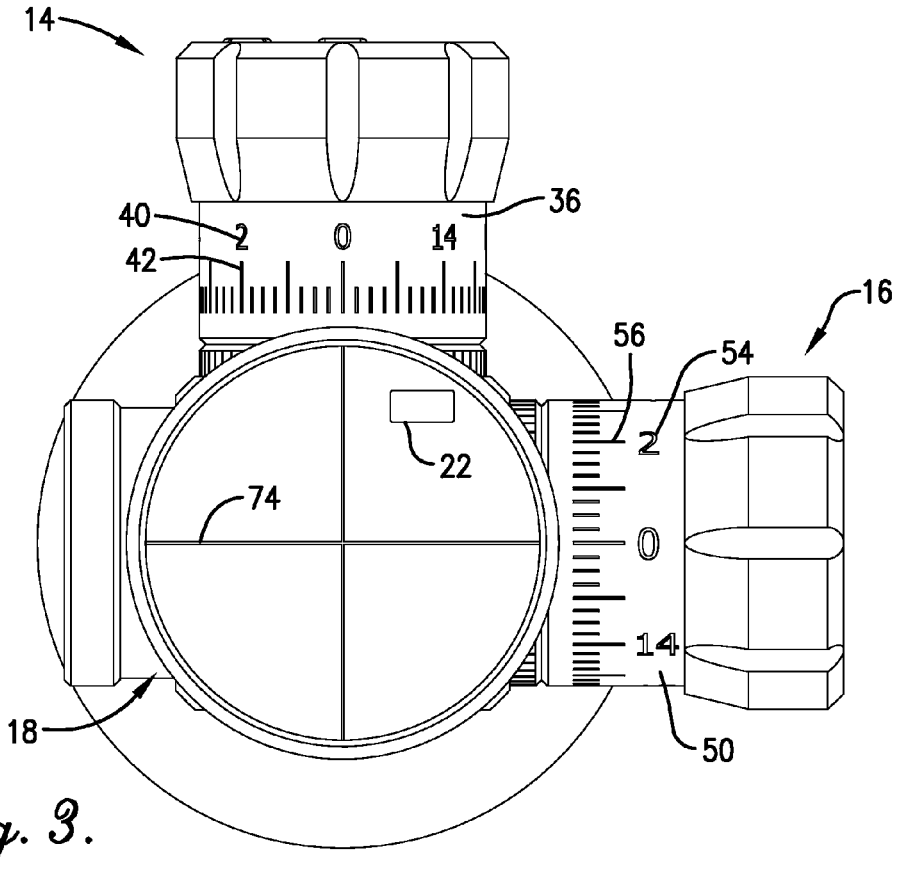
FIG. 3 is a front view of the riflescope with a front view of the eyepiece and side views of the elevation knob and the windage knob.

The eyepiece 18 may include optical components, typically constructed from glass, as are known in the art, such as lenses, or elements, that are combined or grouped to form an assembly that focuses an image on the eye. The eyepiece 18 may further include a reticle 74, as shown in FIGS. 1 and 3. The reticle 74 may be implemented as one or more wires or may be etched and may include a simple crosshair, as shown, or a target dot, a mil-dot, a rangefinding scale, or the like.

The display 22, as seen in FIGS. 1 and 3, may include video, still image, or text displays such as a liquid-crystal display (LCD), a light-emitting diode (LED) display, or the like. With an LCD, the display 22 may include an accompanying light source. In various embodiments, the display 22 may include a multi-digit seven-segment display. In some embodiments, the display 22 may be attached or affixed to the outer surface of the eyepiece 18. In other embodiments, the display 22 may be embedded in the eyepiece 18. Typically, the display 22 is positioned close to the perimeter of the eyepiece 18 so as not to block the view of the target. The display 22 may receive a signal or data from the processor 24 that indicates a target range determined by the setting of the elevation knob 14, an offset determined by the setting of the windage knob 16, the range to the target as retrieved from a rangefinder, or the like, as described in more detail below.

In various embodiments, the riflescope 10 may include a plurality of displays 22. Each display 22 may display different information, such as a first display 22 for displaying a target range determined by the setting of the elevation knob 14 and a second display 22 for displaying an offset determined by the setting for the windage knob 16. The displays 22 may be positioned close to the perimeter of the eyepiece 18.

The processor 24 may include microprocessors, microcontrollers, digital signal processors (DSPs), field-programmable gate arrays (FPGAs), application-specific integrated circuits (ASICs), and the like, or combinations thereof. The processor 24 may generally execute, process, or run instructions, code, software, programs, applications, apps, or the like, or may step through states of a finite-state machine. The processor 24 may receive input from the elevation sensor system 44, the windage sensor system 58, and the user interface 20. The processor 24 may send output to the display 22 and the user interface 20. In addition, the processor 24 may send and receive data from the memory element 26. The processor 24 may be positioned in the body 12 of the riflescope 10, in the elevation knob 14, or in the windage knob 16.

The memory element 26 may include data storage components such as read-only memory (ROM), random-access memory (RAM), hard-disk drives, optical disk drives, flash memory drives, and the like, or combinations thereof. The memory element 26 may include, or may constitute, a "computer-readable medium". The memory element 26 may store the instructions, code, software, programs, applications, apps, or the like that are executed by the processor 24. The memory element 26 may also store settings or data. The memory element 26 may be positioned in the body 12 of the riflescope 10, in the elevation knob 14, or in the windage knob 16.

The riflescope 10 may operate as follows. Before the riflescope 10 is utilized in the field, it may be "zeroed" and then calibrated. Assuming that the riflescope 10 is properly attached to a rifle or appropriate firearm, the zeroing process may begin with a shooter firing the rifle at a target at a range of 100 yards. The shooter may rotate the elevation knob 14 and the windage knob 16 to adjust the elevation and windage settings until a shot aimed at the center of the target hits the center of the target. When this occurs, the shooter may put the knobs 14, 16 in reset mode and rotate both knobs 14, 16 until the elevation numeral 40 "0" aligns with the elevation witness mark 32 and the windage numeral 54 "0" aligns with the windage witness mark 34. At this point, the elevation and windage settings are zeroed and the zeroing process ends.

The shooter may next calibrate the elevation settings for a given projectile, bullet, or cartridge. The calibration may be performed manually or automatically. When the process is performed manually, the shooter may acquire the trajectory settings from a source such as the manufacturer in the form of a printout or data shown on the screen of a portable or handheld device. The trajectory data may include a table with a plurality of range settings and an elevation setting for each range setting. The shooter may manipulate the user interface 20 to set a mode of the processor 24 for data entry. For example, the shooter may activate the set control 70 once or twice to set the mode so that the range to the target is shown on the display 22. The range is typically shown in yards, although it could be displayed in feet or meters. The shooter may adjust the range setting by activating the up control 66 and the down control 68 as needed. When a range is displayed that is listed in the trajectory table, the shooter may then rotate the elevation knob 14 to set the elevation listed in the table. When the proper elevation setting is aligned with the elevation witness mark 32, then the shooter may activate the set control 70 to store (in the memory element 26) the elevation setting for the displayed range. In various embodiments, a lookup table may be created in the memory element 26, wherein the combination of the range value and the elevation setting are stored together. The shooter may continue to enter the trajectory data and store it in the memory element 26 by activating the up control 66 and the down control 68 as appropriate to select a range value, adjusting the elevation knob 14 to the proper setting (as listed in the table), and activating the set control 70 to store the elevation setting for the corresponding range value. After all of the data has been entered, the riflescope 10 may be ready to use.

Calibrating the elevation settings in an automatic fashion requires the trajectory data to be available in an electronic form such as from a device like a rangefinder, a cell phone, a tablet, and the like, or a component like a flash memory drive. The device or component may be coupled to the communications port 64 and the auto control 72 may be activated once or twice to initiate the data download. During the download process, the trajectory data is transferred from the device or component into the memory element 26. In various embodiments, a lookup table may be created in the memory element 26, wherein the combination of the range value and the elevation setting are stored together. Either the display 22 or the device or component may give an indication of when the download process is finished. After the download is complete, the riflescope 10 may be ready to use.

During use, the display 22 may show, by default, the range to a target as determined by the elevation setting. For example, if the display 22 shows "300" (yards), then the elevation knob 14 has been set such that the current type of projectile will hit a target at 300 yards. As the shooter rotates the elevation knob 14, the elevation sensor 48 determines the elevation setting. The processor 24 may retrieve from the memory element 26 the corresponding range value for each elevation setting, and the display 22 may show the corresponding range value. Thus, if the shooter knows that his target is at a range of 400 yards, then he may rotate the elevation knob 14 until "400" is shown on the display 22.

If it is determined that there is a crosswind or the target may be moving, then the shooter may adjust the windage setting by rotating the windage knob 16. The processor 24 may detect that the windage knob 16 is being rotated and may show on the display 22 the offset from center to the left or right that is determined by the windage setting. The display 22 may show the offset in inches, centimeters, or other appropriate units. The windage knob 16 may be rotated in a first direction to change the offset to the left and in an opposing second direction to change the offset to the right. The display 22 may show both the magnitude and the direction of the offset. The magnitude of the offset is generally determined by the range to the target. For a given rotation of the elevation knob 14, the offset may be greater at a longer range and smaller at a shorter range. Thus, in some embodiments, the memory element 26 may also include a lookup table for ranges, windage settings, and offsets. In one implementation, for each range (such as the plurality of ranges discussed above with the elevation settings) the lookup table may include a plurality of windage settings and corresponding offsets. For example, at a range of 500 yards, each windage indicia 56 setting may correspond to an offset of 2.25 inches. This information may be stored in the lookup table. In other embodiments, the processor 24 may calculate the offset given the range value, as determined by the elevation setting, and the windage setting from the windage knob 16.

Hence, in practice, the shooter may need to set the range before adjusting the windage setting. For example, if the target is at a range of 500 yards and a crosswind requires an offset of 7 inches to the left, then the shooter may adjust the elevation knob 14 until "500" is shown on the display 22. The shooter may then rotate the windage knob 16. The processor 24 may detect the activity of the windage knob 16 and may show the offset on the display 22. At this range, each windage indicia 56 may represent 2.25 inches. As the shooter rotates the windage knob 16 in the correct direction, the display 22 may show "−2.25" (indicating 2.25 inches to the left), followed by "−4.50", and "−6.75". For each value shown, the processor 24 may retrieve the offset from the memory element 26 or may calculate the offset. When the display 22 shows "−6.75", the shooter may stop rotating the windage knob 16, that is as close to 7 inches to the left as can be displayed at the given range. Once the shooter stops rotating the windage knob 16, the display 22 may switch back to showing the range after a short period of time. Alternatively, the display 22 may show the windage offset until the shooter rotates the elevation knob 14.

With the riflescope 10 of the current invention, a shooter may rotate the elevation knob 14 and the windage knob 16 and view the changes to the elevation and windage settings on the display 22 while simultaneously viewing a target in the eyepiece 18.

Although the invention has been described with reference to the embodiments illustrated in the attached drawing figures, it is noted that equivalents may be employed and substitutions made herein without departing from the scope of the invention as recited in the claims.

The invention claimed is:

1. A riflescope comprising:
a body;
an elevation knob mounted on the body and configured to generate an elevation setting corresponding to the elevation of the riflescope;
an elevation sensor system with a plurality of elevation position indicators located around the circumference of the elevation knob and an elevation sensor configured to detect the elevation setting via the elevation position indicators;
a windage knob mounted on the body and configured to generate a windage setting corresponding to the left and right offset of the riflescope; and
an eyepiece for viewing a target, the eyepiece including a display configured to show a range to the target as determined by the elevation knob and the offset determined by the windage knob.

2. The riflescope of claim 1, further comprising a memory element configured to store a plurality of range values and associated elevation settings for a given projectile.

3. The riflescope of claim 2, wherein the range value corresponding to the elevation setting is retrieved from the memory element and shown on the display as the elevation knob is rotated.

4. The riflescope of claim 1, wherein each elevation position indicator includes a micro-magnetic fiber.

5. The riflescope of claim 1, wherein the elevation sensor is positioned on the body adjacent to the elevation knob.

6. The riflescope of claim 1, wherein the elevation sensor is configured to detect at least one of the elevation position indicators.

7. The riflescope of claim 1, further comprising a windage sensor system with a plurality of windage position indicators located around the circumference of the windage knob and a windage sensor configured to detect the windage setting via the windage position indicators.

8. The riflescope of claim 7, wherein each windage position indicator includes a micro-magnetic fiber.

9. The riflescope of claim 7, wherein the windage sensor is positioned on the body adjacent to the windage knob.

10. The riflescope of claim 7, wherein the windage sensor is configured to detect at least one of the windage position indicators.

11. A riflescope comprising:
a body;
an elevation knob mounted on the body and configured to generate an elevation setting corresponding to the elevation of the riflescope;
an elevation sensor system with a plurality of position indicators located around the circumference of the elevation knob and an elevation sensor configured to detect the elevation setting via the elevation position indictors;
a windage knob mounted on the body and configured to generate a windage setting corresponding to the left and right offset of the riflescope;
a windage sensor. . .adjacent to the windage knob and configured to detect the windage setting; and
an eyepiece. . .and the offset determined by the windage knob.

12. The riflescope of claim 11, further comprising a memory element configured to store a plurality of range values and associated elevation settings for a given projectile.

13. The riflescope of claim 12, wherein the range value corresponding to the elevation setting is retrieved from the memory element and shown on the display as the elevation knob is rotated.

14. The riflescope of claim 11, further comprising a plurality of windage position indicators located around the circumference of the windage knob, wherein the windage sensor is configured to detect at least one of the windage position indicators.

15. A riflescope comprising:
a body;
an elevation knob mounted on the body and configured to generate an elevation setting corresponding to the elevation of the riflescope;
an elevation sensor system with a plurality of elevation position indicators located around the circumference of the elevation knob and an elevation sensor positioned on the body adjacent to the elevation knob configured to detect the elevation setting;
a windage knob mounted on the body and configured to generate a windage setting corresponding to the left and right offset of the riflescope;
a windage sensor system with a plurality of windage position indicators located around the circumference of the windage knob and a windage sensor positioned on the body adjacent to the windage knob configured to detect the windage setting; and
an eyepiece for viewing a target, the eyepiece including a display configured to show a range to the target as determined by the elevation knob and the offset determined by the windage knob.

16. The riflescope of claim 15, wherein the elevation sensor is configured to detect at least of the elevation position indicators.

17. The riflescope of claim 15, wherein the windage sensor is configured to detect at least of the windage position indicators.

18. A riflescope comprising:
a body;
an elevation knob mounted on the body and configured to generate an elevation setting corresponding to the elevation of the riflescope;

a windage knob mounted on the body and configured to generate a windage setting corresponding to the left and right offset of the riflescope;

a windage sensor system with a plurality of windage position indicators located around the circumference of the windage knob and a windage sensor configured to detect the windage setting via the windage position indicators; and an eyepiece for viewing a target, the eyepiece including a display configured to show a range to the target as determined by the elevation knob and the offset determined by the windage knob.

* * * * *